US005353372A

United States Patent [19]

Cook et al.

[11] Patent Number: 5,353,372

[45] Date of Patent: Oct. 4, 1994

[54] ACCURATE PITCH MEASUREMENT AND TRACKING SYSTEM AND METHOD

[75] Inventors: Perry R. Cook; Julius O. Smith, both of Palo Alto, Calif.

[73] Assignee: The Board of Trustees of the Leland Stanford Junior University, Stanford, Calif.

[21] Appl. No.: 825,932

[22] Filed: Jan. 27, 1992

[51] Int. Cl.[5] ..... G10L 9/02; G10L 9/14; G10L 9/08

[52] U.S. Cl. ..... 395/2.16; 395/2.25

[58] Field of Search ..... 395/2.16, 2.17, 2.2, 395/2.23, 2.25–2.27; 381/38, 39; 364/724.16, 724.17, 724.19

[56] References Cited

U.S. PATENT DOCUMENTS

| | | | |
|---|---|---|---|
| 3,740,476 | 6/1973 | Atal | 395/2.16 |
| 3,947,638 | 3/1976 | Blankinship | 395/2.16 |
| 4,004,096 | 1/1977 | Bauer et al. | 395/2.16 |
| 4,852,169 | 7/1989 | Veeneman et al. | 381/38 |
| 4,879,748 | 11/1989 | Picone et al. | 381/49 |
| 4,989,250 | 1/1991 | Fujimoto | 395/2.16 |
| 5,093,863 | 3/1992 | Galand et al. | 395/2.16 |
| 5,171,930 | 12/1992 | Teaney | 381/49 |

*Primary Examiner*—David D. Knepper

*Attorney, Agent, or Firm*—Flehr, Hohbach, Test, Albritton & Herbert

[57] ABSTRACT

A quasi-periodic signal is sampled at a specified rate, and then a predicted value of the signal is computed from a set of 2M+1 time lagged signal samples. The time lagged samples are centered in time at an integer multiple P of the signal's sampling period $T_s$, where $P \cdot T_s$ is approximately one period of the input signal. The predicted signal value is computed by multiplying each of the 2M+1 time lagged samples by a corresponding predictor coefficient c(i) and then summing the resulting products. The predicted signal value is subtracted from the actual signal value to obtain an error signal $\epsilon$. During each successive sampling period, the predictor coefficients are updated by adjusting the previously computed predictor coefficients by an amount proportional to the error $\epsilon$ multiplied by each of the 2M+1 time lagged signal values. Using the updated coefficient values, a phase delay is computed, and then the signal's period is computed as the sum of phase delay and $P \cdot T_s$, which is the average integer time lag of the sampled signal values. When the phase delay is greater than one half of the sampling period $T_s$, the value of P is increased or decreased, as necessary, to keep the time lagged signal samples approximately one period delayed from the current signal sample.

17 Claims, 3 Drawing Sheets

ACCURATE PITCH MEASUREMENT AND TRACKING SYSTEM AND METHOD

The present invention relates generally to pitch detection systems and methods for detecting the pitch of quasi-periodic sound sources.

BACKGROUND OF THE INVENTION

Pitch detection is of interest whenever a single quasi-periodic sound source is to be studied or modeled. For instance, the trajectory of a sound's pitch, also called the fundamental frequency, over a period of time can also be used to synthesize similar or related sounds using various speech or music synthesis techniques. An example of a quasi-periodic sound source is a singer's voice singing a particular note (e.g., high C). The sound generated by the singer typically has a certain amount of vibrato, or pitch modulation, noise and aperiodicity in the wave shape, making the sound quasi-periodic rather than a pure periodic signal.

Prior art pitch detection methods can be classified into three categories: frequency domain techniques, time domain techniques, and methods which use both techniques. The present invention is a time domain detection technique.

Important characteristics of a commercially useful pitch tracker are (1) real time operation on signals in the 0 to 5 KHz range using inexpensive hardware, (2) accuracy, and (3) generation of pitch values at regular (uniform) time intervals. Another useful characteristic is the ability to detect when the pitch tracker has lost track of the input signal, as may happen when the pitch of the input signal suddenly jumps, and to recapture the input signal without human intervention.

In time domain "feature detection" methods, the input signal is usually preprocessed to accentuate some time domain feature, and then the time between occurrences of that feature is calculated as the period of the signal. The pitch and period of the input signal are related by the equation:

$$\text{Pitch} = \frac{1}{\text{Period}} \qquad \text{(Eq. 1)}$$

A typical time domain feature detector is implemented by low pass filtering the signal, then detecting peaks or zero crossings of the filtered signal. Since the time between occurrences of a particular feature is used as the period estimate, feature detection schemes usually do not use all of the data available. Selection of a different feature often yields a different set of pitch estimates. Since estimates of the period are often defined at the instant when the features are detected, the frequency samples yielded are not uniformly distributed in time. To avoid the problem of non-uniform time sampling, a window of fixed size is moved through the signal, and a number of detected periods within each window are averaged to obtain the period estimate.

Autocorrelation Function

Other prior art time domain methods include the use of autocorrelation functions or difference norms to detect the similarity between the waveform and a time lagged version of itself. The autocorrelation method works as follows. The input signal is sampled and stored at discrete time intervals, such as every 0.1 milliseconds. Then autocorrelation of the input signal is computed as follows:

$$x \times x(m) = \sum_{i=q}^{q+N-1} x(i)x(i+m) \qquad \text{(Eq. 2)}$$

where q represents a starting point in the input signal, and N is an integer representing the number of signal samples to be used in the computation. The main peak in the autocorrelation function is at the zero-lag location, m=0. The location of the next peak gives an estimate of the input signal's period, and the height of the autocorrelation function given an indication of the periodicity of the signal. Disadvantages of this method are (1) that it is computationally intensive, making real time operation difficult or impossible, and (2) it only gives a rough estimate of the signal's period with an accuracy no finer in time resolution thant the sampling period. One advantage of the autocorrelation method is that it generates a pitch value without requiring any prior information about the approximate value of the pitch.

Average Magnitude Difference Function

Another prior art time domain pitch tracking method is called the Average Magnitude Difference Function (AMDF). The AMDF pitch detection method is the complement of the autocorrelation function, in that it measures the difference between the waveform and a time lagged version of itself. The AMDF function is:

$$AMDF(m) = \sum_{i=q}^{q+N-1} |x(i) - x(i+m)| \qquad \text{(Eq. 3)}$$

The zero lag, m=0, position of the AMDF function is identically zero, and the next significant null is a likely estimate of the period. Other nulls will occur at integer multiples of the period. The signal can be preprocessed, using techniques known to those skilled in the art, to aid in detection of the first null. A primary advantage of this pitch detection method is that has a smaller computational burden than the autocorrelation method, because it uses subtraction where autocorrelation uses multiplication.

The difficulties of the AMDF pitch detection method arise from the finite sampling rate of the signal, noise, and signal stationarity. If the signal is truly periodic with period $T_0$, and $T_0$ is an integer multiple of the sampling period $T_s$, then all nulls at integer multiples of $T_0$ will be identically zero. However, if the period of the signal is not an integer multiple of $T_s$, the first null ($m \neq 0$) actually exists between two values of m. For example, if the sampling period is 0.1 milliseconds, and the input signal has a pitch of 440 Hz and a period of 0.002272727 seconds, then the true first null will be between samples m=22 and m=23. A coarse estimate of pitch is tolerable for many speech applications, but is not acceptable for analysis and synthesis of music. Compared to the small computational burden of computing the AMDF, there is no known economical method of accurately interpolating between samples to find the true period. This implies that the sampling rate must be sufficiently high to yield the high accuracy required for musical applications.

If the signal is quasi-periodic (e.g., amplitude modulated, frequency modulated, or corrupted by noise), the nulls will never be zero, even if $T_0$ is an integer multiple of $T_s$. The problem of interpolation between lag samples to obtain an accurate pitch estimate is even further complicated in the case of a frequency modulated signal.

The present invention is an improvement on the AMDF pitch detection method. Using a FIR (finite impulse response) filter model, the present invention provides a methodology for computing a signal's period with great accuracy.

SUMMARY OF THE INVENTION

In summary, the present invention is a system and method for tracking the pitch of quasi-periodic signals. The quasi-periodic signal is sampled at a specified rate, and then a predicted value of the signal is computed from a set of 2M+1 time lagged signal samples. The time lagged samples are centered in time at an integer multiple P of the signal's sampling period $T_s$, where $P \cdot T_s$ is approximately one period of the input signal. The predicted signal value is computed by multiplying each of the 2M+1 time lagged samples by a corresponding predictor coefficient c(i), and then the predicted signal value is subtracted from the actual signal value to obtain an error signal $\epsilon$.

During each successive sampling period, the predictor coefficients are updated by adjusting the previously computed predictor coefficients by an amount proportional to the error $\epsilon$ multiplied by each of the 2M+1 time lagged signal values:

$$C_{k+1} = C_k + 2\mu X_k \epsilon(k)$$

where $C_k$ is a vector containing the 2M+1 predictor coefficients computed for time period k, $2\mu$ is an adaption parameter that controls the rate at which the prediction coefficients are adjusted, and $X_k$ is a vector containing the 2M+1 time lagged signal values at time period k. Using the updated coefficient values, a phase delay is computed, and then the signal's period is computed as the sum of phase delay and $P \cdot T_s$:

$$\text{Period} = P \cdot T_s + \text{Phase Delay}$$

When the phase delay is greater than one half of the sampling period $T_s$, the value of P is increased or decreased, as necessary, to keep the time lagged signal samples approximately one period delayed from the current signal sample.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

Figure 1:
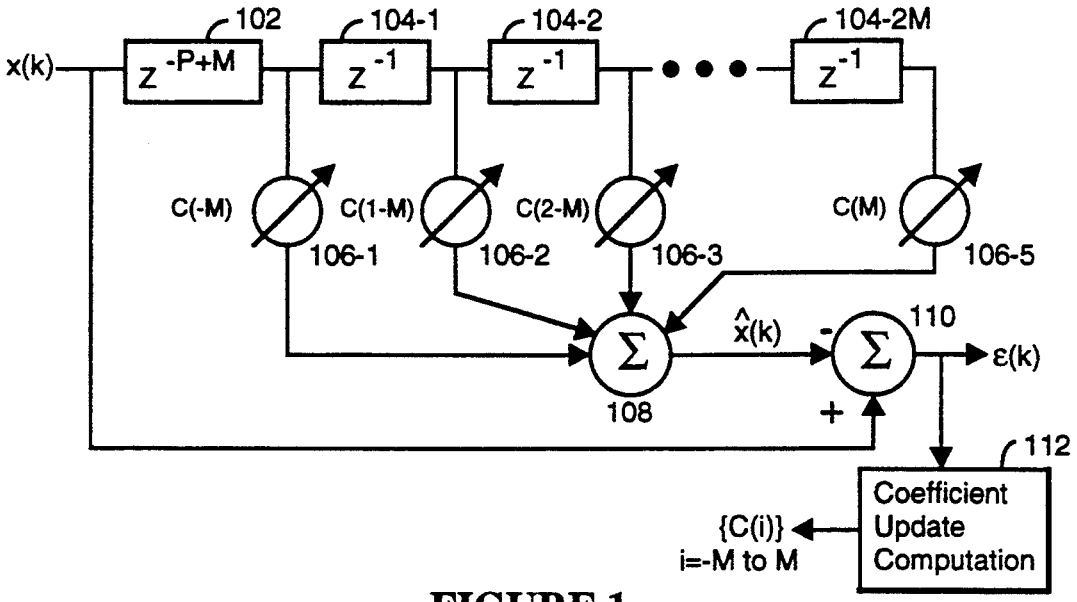
FIG. 1 is a block diagram of an FIR signal predictor in accordance with the present invention.

Referring to FIG. 1, the pitch tracker of the present invention is conceptually a tapped delay line implemented using a sequence of delay elements 102, 104 for generating time lagged representations of an input signal x(k). The first delay element 102 has a delay length of P−M where P is an integer number of time sample periods representing a rough estimate of the signal's period. For example, if the input signal were a 440 Hz tone, and the sample period $T_s$ were 0.1 milliseconds, P would be 23, representing an approximate period of 2.3 milliseconds. The number of subsequent unitary time delays 104 is 2M, where M is usually a small integer such as 1, 2 or 3 and preferably less than eight. It should be understood that the invention can be used with any selected integer value of M, but that larger values of M will incur additional computational expense.

A weighted sum of 2M+1 samples of the time lagged signal, at time delays ranging from P−M to P+M, are formed using multipliers 106 and summer 108. The weights applied to each time lagged samples are called predictor coefficients c(−M) to c(+M). The resulting estimated signal value is herein called x(k):

$$\hat{x}(k) = \sum_{i=-M}^{M} x(k - P + i)c(i) \qquad \text{(Eq. 4)}$$

As will be discussed below, the predictor coefficients are selected so that the estimated signal $\hat{x}(k)$ matches the input signal as closely as possible.

The estimated signal value $\hat{x}(k)$ is subtracted from the current signal value x(k) by summer 110, thereby generating an error signal $\epsilon(k)$. As shown in FIG. 1, the results of this computation are then used by a computation unit 112 to update the values of the predictor coefficients c(i) for i=−M to +M. Methods for computing and updating these coefficients will be discussed below in the section entitled "Computation of Predictor Coefficients". For now, it should be assumed that the pitch tracking system computes the optimal coefficient values so as to minimize the mean square error (MSE)$\overline{\epsilon^2}$ (also called the error signal power), which is the average value of the square of the error signal $\epsilon(k)$.

Digital Signal Processor Implementation

Figure 2:
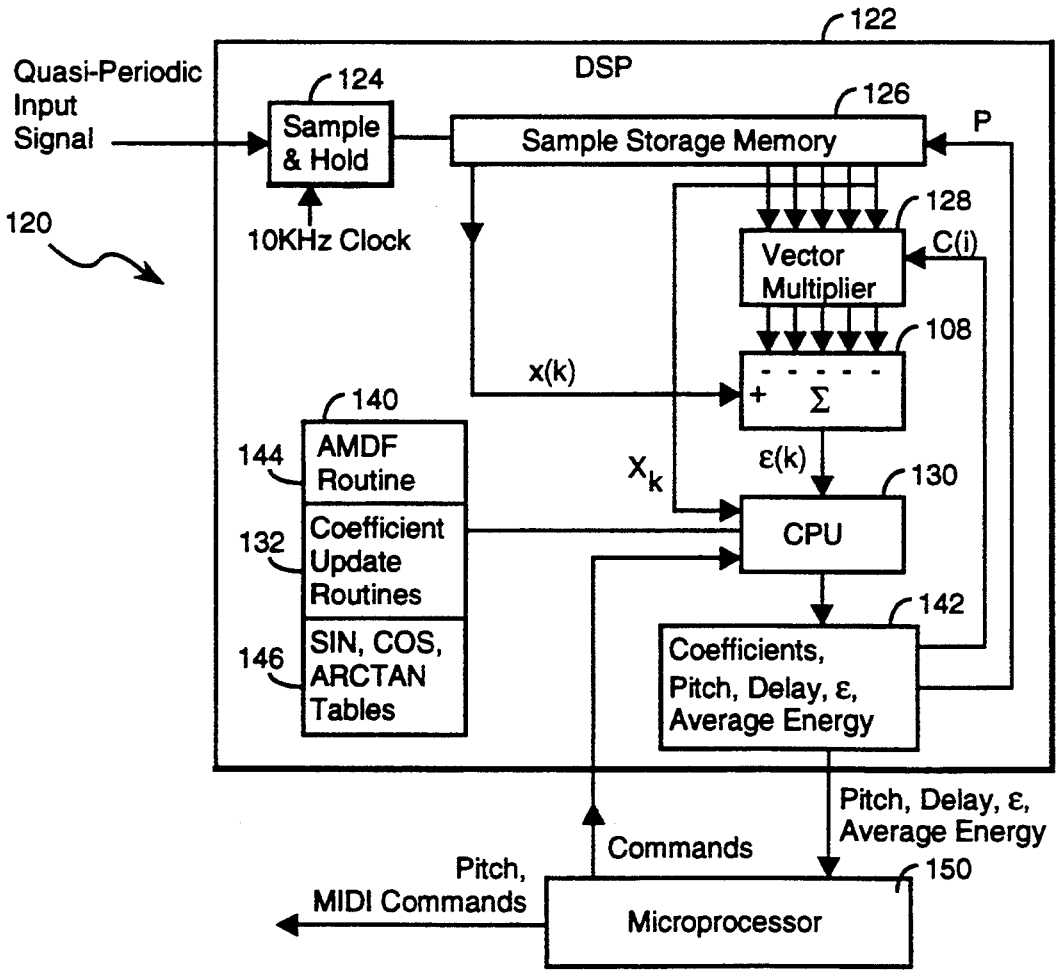
FIG. 2 is a block diagram of the hardware of a preferred embodiment of a pitch tracking system in accordance with the present invention.

Referring to FIG. 2, the preferred embodiment 120 of the pitch tracker of FIG. 1 uses a digital signal processor 122, such as the 56001 made by Motorola. The DSP 122 includes an analog to digital converter (ADC) 124 for sampling a quasi-periodic input signal at discrete time intervals, such as once every 0.1 milliseconds (i.e., at a rate of 10 KHz). The signal samples are stored by the DSP in signal storage memory 126, which can either be a shift register or a block of random access memory configured as a circular buffer, or a combination of these two (i.e., a shift register can be used for the last 2M+1 elements of the memory 126, while random access memory is used for the first P−M elements of the memory 126). The size of the signal memory 126 is governed by the lowest frequency signal that may need to be detected. For instance, if input signals with pitch as low as 20 Hz may be received, and a 10 KHz sample clock is being used, the signal storage memory would need to be able to hold approximately 510 signal samples (i.e., 500 samples for one period, plus M additional samples for use by the FIR filter).

Next, a vector multiplier 128 is used to multiply the last 2M+1 time lagged signal samples by their corresponding predictor coefficients, and a summer is used to subtract the resulting 2M+1 values from the current signal sample value x(k) to produce an error value $\epsilon(k)$. During each sampling period, a central processing unit 130 in the DSP receives the error value $\epsilon(k)$ as well as a vector $X_k$ comprising the 2M+1 time lagged signal values, and then computes a new set of predictor coefficients using one of a number of coefficient update routines 132 stored in the DSP's software memory 140. The resulting coefficient values, as well as a computed period, pitch, and average signal energy value are stored in a parameter memory 142.

In the preferred embodiment, when the DSP 122 is initialized upon power up or upon being reset, it computes an initial approximate Period value equal to an integer P number of sample periods using the AMDF technique described above. Thus, an AMDF routine 144 stored in the software memory 140 is executed by the CPU 130 at initialization, thereby generating an initial period value P.

Also stored in the software memory 140 are sine, cosine and arctan tables 146 which are used in certain computations, described below, to calculate sine, cosine and arctan values by interpolated table lookup.

Finally, for reasons that are described below, a microprocessor 150, such as the 68000 made by Motorola, is used to monitor the DSP's operation by monitoring parameters such as the computed pitch, phase delay, integer delay P, average signal energy, and error signal $\epsilon(k)$. As will be described below, when the monitoring microprocessor 150 determines that the absolute value of the phase delay in the FIR filter exceeds half of a sampling period, it commands the DSP's CPU 130 to either increment or decrement the integer delay P so as to keep the FIR filter centered on the signal's period. The monitoring microprocessor 150 also can be used to periodically generate MIDI commands (to be sent to a musical synthesizer) or other data signals reflecting the pitch value detected by the DSP 122.

Determining the Phase Delay of the FIR Filter

The phase $\Theta$ of the FIR filter, relative to the Pth delayed sample, is a function of the coefficients:

$$\Theta = \arctan\left(\frac{\sum_{i=-M}^{M} c(i)\sin(\omega i)}{\sum_{i=-M}^{M} c(i)\cos(\omega i)}\right) \quad \text{(Eq. 5)}$$

The angular frequency $\omega$ in the above equation is the frequency of the input signal. In other words, $$\omega = \frac{2\pi}{T_0} \approx \frac{2\pi}{PT_S} \quad \text{(Eq. 6)}$$

where $T_0$ is the actual period of the input signal and $P \cdot T_s$ is a rough estimate of the input signal's period.

Using the above equations, the phase delay of the filter is computed as:

$$\text{Phase Delay} = \frac{\Theta}{\omega} \quad \text{(Eq. 7)}$$

By adding the computed Phase Delay to the time delay $P \cdot T_s$ associated with the center delay element of the filter, the net time delay of the predictor is computed. This total delay is then used to compute a period and frequency estimate:

$$\text{Period} = T_0 = P \cdot T_s + \text{Phase Delay} \quad \text{(Eq. 8)}$$

$$\text{Frequency} = F_0 = 1/T_0 \quad \text{(Eq. 9)}$$

where $T_s$ is the sampling period in seconds and $T_0$ is the period estimate.

Since $T_0$ is not precisely known when the pitch tracker first begins its initial calculation, the initial value of $\omega$ is somewhat coarse, which in turn causes the first computed value of the FIR filter phase $\Theta$ to be somewhat coarse. If a more accurate estimate is required, the last computed Period value is used to compute $\omega$, or the calculation of $\omega$ and the pitch estimate is iterated until a desired accuracy is reached.

The number of computations required to compute the FIR filter phase $\Theta$ can be reduced by exploiting the symmetry of the cosine and sine functions, as well as the symmetry of the filter definition. Equation 5 reduces to:

$$\Theta = \arctan\left(\frac{\sum_{i=1}^{M} (c(i) - c(-i))\sin(\omega i)}{c(0) + \sum_{i=1}^{M} (c(i) - c(-i))\cos(\omega i)}\right) \quad \text{(Eq. 10)}$$

For further computational savings, sine, cosine and arctan values can be calculated by interpolated table lookup.

Computation of Predictor Coefficients

The key to keeping the pitch detector "tuned" to the incoming signal and to accurately computing the period of that signal is computing a set of predictor coefficients that minimize the mean square error (MSE)$\overline{\epsilon^2}$. The following is a presentation of three different techniques for computing these coefficients, herein called the Covariance method, the Recursive Least Squares (RLS) method, and the Least Mean Squares (LMS) method. In the preferred embodiment, the LMS method is used because it is reasonably accurate and because it requires the least number of computations, which enables real time performance using modest equipment.

The Covariance method of computing prediction coefficients works as follows. The coefficients c(i) are assumed to implement a least squares prediction of the input signal's value at a point P steps ahead of a selected point in time. A set of coefficients is computed over a defined data set, such as a set of 128 signal samples. The coefficients solve the following linear set of equations:

$$RC = r \quad \text{(Eq. 11)}$$

where C is the vector of predictor coefficients, r is the P-delayed covariance vector, $$r = \begin{pmatrix} E[x(i)x(i+P-M)] \\ E[x(i)x(i+P+1-M)] \\ \vdots \\ E[x(i)x(i+P+M)] \end{pmatrix}$$

and R is a square matrix of expectation values:

$$R = \begin{pmatrix} E[x(i)x(i)] & E[x(i)x(i+1)] & \cdots E[x(i)x(i+2M)] \\ E[x(i+1)x(i)] & E[x(i+1)x(i+1)] & \cdots E[x(i+1)x(i+2M)] \\ \vdots & \vdots & \vdots \\ E[x(i+2M)x(i)] & E[x(i+2M)x(i+1)] & \cdots E[x(i+2M)x(i+2M)] \end{pmatrix}$$

where the expectation function E[] here is defined as:

$$E[x(i+a)x(i+b)] = \frac{1}{N}\sum_{i=0}^{N-1} x(i+a)x(i+b) \quad \text{(Eq. 12)}$$

If the matrix R is invertible, the coefficient vector C is given by $$C = R^{-1}r \quad \text{(Eq. 13)}$$

The input signal is processed in blocks of length N (e.g., 128 samples), yielding a set of predictor coefficients and thus a period estimate, for each block. Calculating each set of coefficients requires 2NM multiplies to compute the covariance matrix and on the order of $M^3$ operations for the matrix inversion. Since M is small, the size of the R matrix is small and therefore most of the computational burden is associated with computation of the elements of the covariance matrix R.

The Recursive Least Squares coefficient computation method implements a recursive approximate Newton's method solution of equation 13. The covariance matrix R is approximated by an exponentially decaying sample mean:

$$\hat{R}_k = (1-\alpha)\hat{R}_{k-1} + \alpha X_k X_k^T \quad \text{(Eq. 14)}$$

where $\alpha$ is a tunable decay parameter with a value between 0 and 1, $$X_k = \begin{pmatrix} x(k) \\ x(k+1) \\ \vdots \\ x(k+2M) \end{pmatrix}$$

and $$X^T_k = \{x(k), x(k+1), x(k+2), \ldots x(k+2M)\}$$

The covariance matrix at this point can be inverted directly. To reduce computation, however, the matrix inversion can be updated recursively using the following matrix inversion lemma:

$$(A+BC)^{-1} = A^{-1} - A^{-1}B(A^{-1}B + C^{-1})A^{-1} \quad \text{(Eq. 15)}$$

to get the following equation:

$$\hat{R}_k^{-1} = \frac{\hat{R}_{k-1}^{-1}}{\lambda} - \frac{\alpha \hat{R}_{k-1}^{-1} X_k X_k^T \hat{R}_{k-1}^{-1}}{\lambda(\lambda + \alpha X_k^T \hat{R}_{k-1}^{-1} X_k)} \quad \text{(Eq. 16)}$$

where $\lambda = 1-\alpha$. With this estimate of the autocovariance matrix, the predictor coefficients are updated adaptively:

$$C_{k+1} = C_k + \alpha \hat{R}^{-1}{}_k X_k \epsilon(k) \quad \text{(Eq. 17)}$$

The number of operations required to perform the RLS method is on the order of $M^2$, but since M is typically low, other computational factors usually dominate. To avoid numerical problems, the $\hat{R}^{-1}$ matrix may have to be updated using matrix factorization techniques.

The Least Mean Squares method is a gradient steepest descent methodology using the instantaneous error $\epsilon(k)$ to estimate the gradient of the error surface. Each coefficient is adjusted each sample period by an amount proportional to the product of (A) the instantaneous error $\epsilon(k)$ and (B) the signal value which is associated with the coefficient being adjusted. This corresponds to setting the $R^{-1}$ matrix to the identity matrix in the RLS coefficient equation 17, and yields the LMS update equation:

$$C_{k+1} = C_k + 2\mu X_k \epsilon(k) \quad \text{(Eq. 18)}$$

The adaption parameter $2\mu$ replaces $\alpha$ by convention from the Newton's method derivative (the factor of two comes from taking the multi-dimensional derivative of the error function), and controls the dynamics and stability of the process of adapting the coefficient values. Stability is ensured if:

$$0 < \mu < ((2M+1)\overline{x^2})^{-1} \quad \text{(Eq. 19)}$$

where $\overline{x^2}$ is the signal power. The adaption parameter $\mu$ can be adapted dynamically, yielding the Normalized LMS equation:

$$C_{k+1} = C_k + \alpha X_k \epsilon(k) / \{2(2M+1)\overline{x^2}\} \quad \text{(Eq. 20)}$$

where $0 < \alpha < 1$.

Pitch Tracking Methodology Using LMS Coefficient Computation

Figure 3:
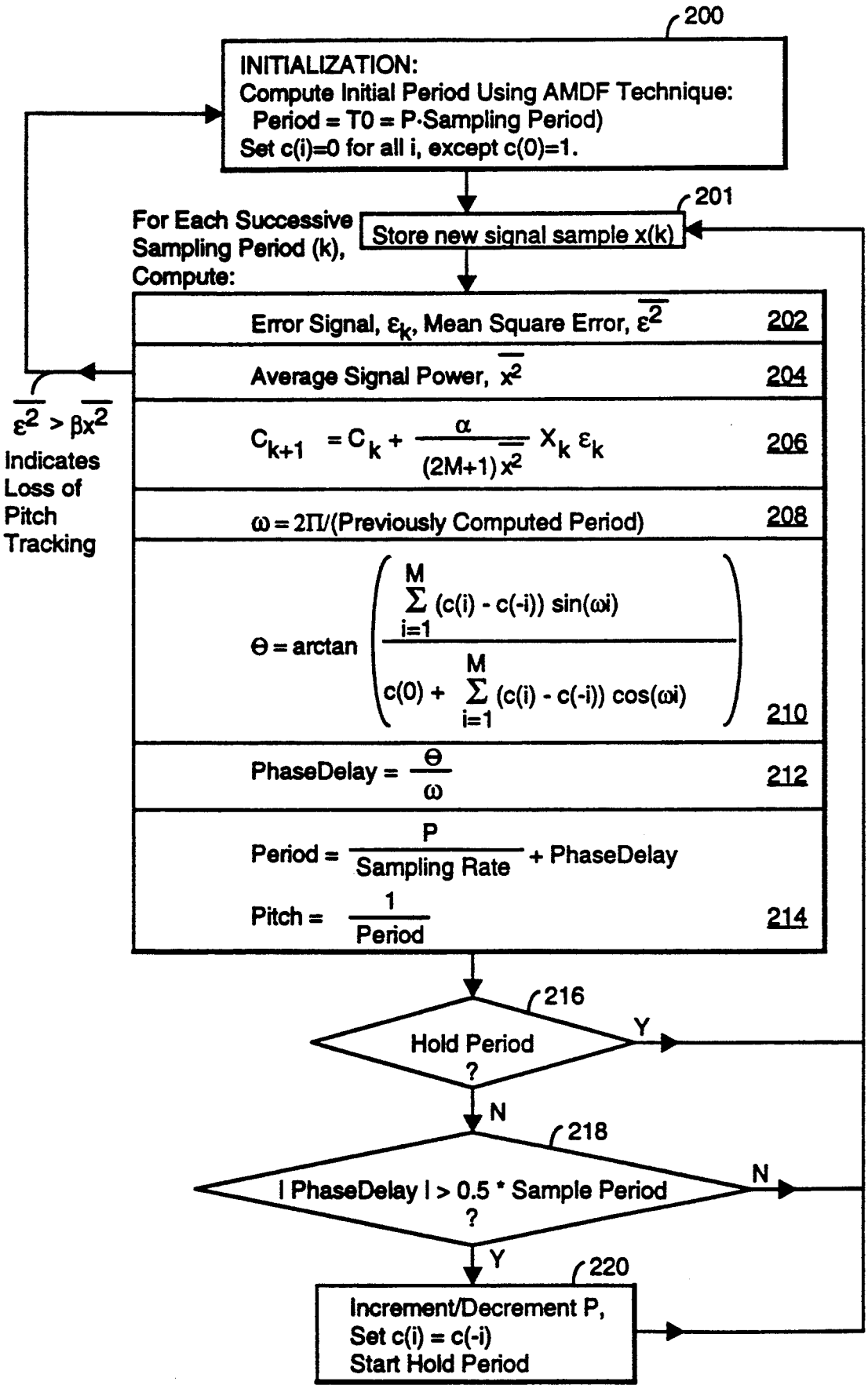
FIG. 3 is a flow chart of a preferred embodiment of the pitch tracking method of the present invention.

The steps of the pitch tracking methodology were discussed above in a different order from the order in which steps are performed. Referring to FIG. 3, at initialization, the process starts at step 200 by sampling the quasi-periodic input signal for N sampling periods (where $NT_s$ is larger than the period of the lowest pitch input signal in a predefined range of pitch values) and then using the AMDF technique to compute an initial period value $T_0$ which is integer number P of sampling periods. Also, all the predictor coefficients are set to a value of zero, except c(0) which is set to a value of 1.

After storing the new input signal sample for each successive sampling period (step 201), the following computations are performed, in sequence. First (at step 202) the error signal $\epsilon(k)$ is computed using the current signal sample values and the most recently computed predictor coefficients c(i). At step 204 the average signal power $\overline{x^2}$ is updated, and then at step 206 the predictor coefficients c(i) are updated using equation 20 (see above). At step 208 the angular frequency $\omega$ is computed based on the previously computed period value, and then the FIR filter's phase is computed at step 210 using equation 5. At step 212, the FIR filter's phase delay is computed as the FIR filter's phase $\Theta$ divided by frequency $\omega$. Finally, at step 214 the input signal's period is computed by adding the computed phase delay to the integer time delay of the FIR filter $P \cdot T_s$, and the pitch is computed as the inverse of the computed period.

Steps 216 and 218 of the method are performed by the monitoring microprocessor in the preferred embodiment and concern the process of changing the integer delay period of the FIR filter as the pitch of the input signal increases or decreases. Whenever the integer delay period P of the FIR filter is changed by the digital signal processor (step 220), a "hold period" is started during which time further adjustment of the integer delay period P is prevented. The hold period would typically be between 50 and 100 sample periods for a system with 0.1 millisecond sample period (i.e., a 10 KHz sampling clock). The hold period is invoked in order to prevent rapid oscillation of the integer delay period, by allowing the prediction coefficients to reach their optimal values after each adjustment of the integer delay period P. Thus, at step 216, if a hold period is in effect, the process resumes at step 202 for processing the next sample period's data and time lagged data.

If at step 216 it is determined that a hold period is not in effect, step 218 determines whether the magnitude of the FIR filter's phase delay is larger than a half sampling period ($0.5T_s$). If not, the process resumes running at step 202. If the phase delay's magnitude does exceed $0.5T_s$, at step 220 the filter's integer delay period P is increased by one if the phase delay is larger than 0.5 sample periods. Otherwise, at step 220 the filter's integer delay period is less than $-0.5$ sample periods, and therefore the integer delay period is decreased by one. Then the prediction coefficients are swapped in accordance with equation 21, and a holding period is started, as discussed above.

$$c(i) \rightleftarrows c(-i) \text{ for } |i| \leqq M \qquad \text{(Eq. 21)}$$

It should be noted that with a five element FIR filter, the predictor coefficients will accurately reflect phase delays of up about two sampling periods. To track even faster moving pitch changes, or to increase noise immunity, the number of FIR filter elements should be increased, for example, to seven. At step 220 the phase delay could be further tested to see if the magnitude of the phase delay is greater than 1.5 sampling periods, and if so, then the integer phase delay P would be increased or decreased (in accordance with the sign of the phase delay) by a value of two.

Another function performed by the monitoring microprocessor is to monitor the pitch tracker's error signal for sudden increases. The error signal indicates when the pitch tracker has lost track of the input signal, such as when the pitch of the input signal suddenly changes by a large amount or otherwise changes faster than the pitch tracker can follow, or that the input signal has ceased to be quasi-periodic. When the error signal's value indicates that the pitch tracker has lost track of the input signal, the monitoring microprocessor sends commands to the DSP forcing it to restart is computation at step 200, where it recaptures the pitch of the input signal using the AMDF technique.

To detect loss of tracking, the mean square error MSE (equal to the average of the square of the error signal $\epsilon(k)$ over several sample periods) is compared with signal power $\overline{x^2}$. When error signal power (MSE) is greater than a preselected fraction of the signal power (i.e., $MSE > \beta\overline{x^2}$, where $\beta$ is typically between 0.2 and 0.8), the pitch tracker attempts to re-acquire a lock on the signal by returning to step 200.

Alternate Pitch Tracking System Architectures

Figure 4:
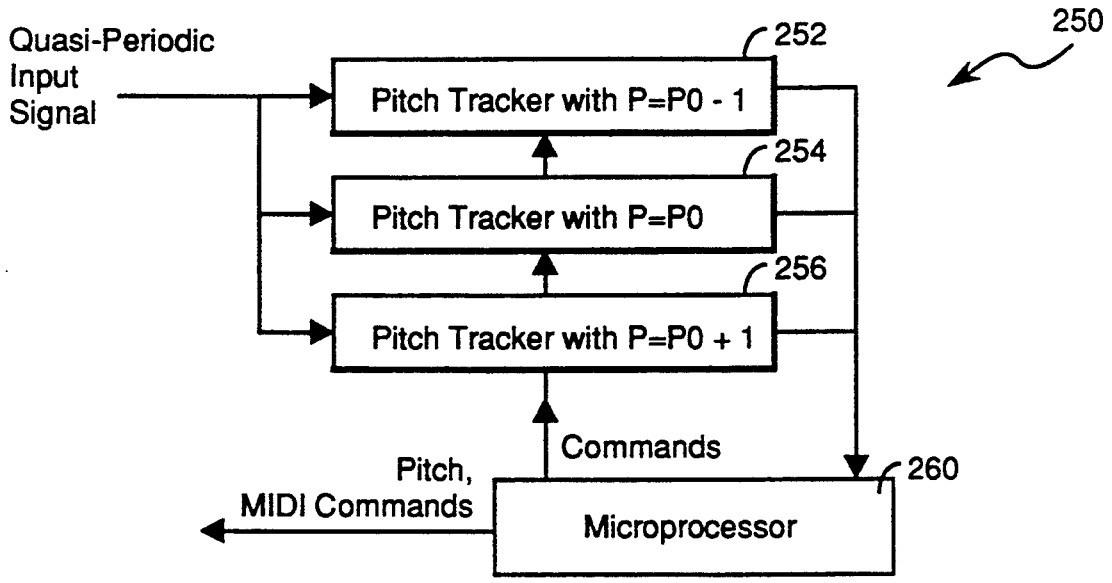
FIG. 4 is a block diagram of a pitch tracker using three parallel pitch tracking subsystems.

Referring to FIG. 4, system 250 uses three parallel pitch trackers 252, 254 and 256 to avoid the settling time problems associated with the system shown in FIG. 2. Each of these pitch trackers is equivalent to the DSP implemented pitch tracker of FIG. 2, and the associated microprocessors are combined here into one monitoring microprocessor 260. The three pitch trackers are configured so that one pitch tracker 254 has an integer delay P0 while the other two pitch trackers have integer delays of P0−1 and P0+1. All three pitch trackers 252, 254 and 256 sample the input signal every period and compute the optimal prediction coefficients for that pitch tracker. As will be appreciated by those skilled in the art, some of the calculations for the three pitch trackers can be shared, allowing three pitch trackers to be implemented at relatively low computational cost.

The monitoring microprocessor 260 monitors the FIR filter phase delay of center pitch tracker 254. If the phase delay is greater than $0.5T_s$, the integer delay in all three trackers is increased by one, the predictor coefficients of the center pitch tracker with delay period P0 (now increase by one) are copied to the P0−1 pitch tracker 252. The predictor coefficients of the P0+1 pitch tracker 256 are copied to the P0 pitch tracker 254, and the coefficients of the P0+1 pitch tracker 256 are time reversed as in equation 21 above.

When the detected pitch of the input signal decreases, causing the phase delay of pitch tracker 254 to be less than $-0.5T_s$, a complimentary set of operations is performed:

- Copy the coefficients of the P0 pitch tracker 254 to the P0+1 pitch tracker 256;
- Copy the coefficients of the P0−1 pitch tracker 252 to the P0 pitch tracker 254;
- Time reverse the coefficients of the P0−1 pitch tracker 252.

A hold period between coefficient swaps is required to avoid rapid oscillation of the delay line length when the input signal's period is near a 0.5 sample boundary, and also to allow the time reversed coefficients to adapt to optimal values.

Figure 5:
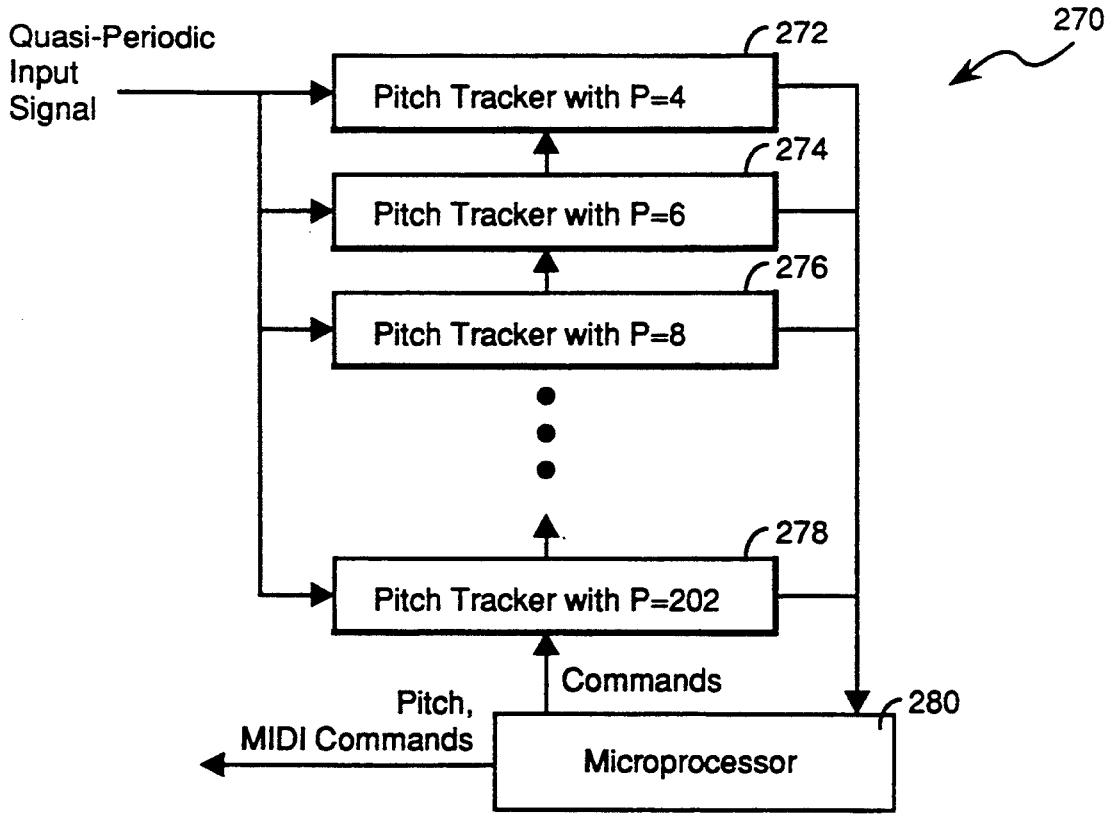
FIG. 5 is a block diagram of a pitch tracker system using a large number of parallel pitch tracking subsystems.

In FIG. 5, there is shown a system 270 with an array of one hundred parallel pitch trackers 272 to 278 for monitoring a defined frequency range, such as 49 Hz to 2500 Hz. The pitch trackers have preset integer delays varying in increments of two from a predefined low value (e.g., 4) associated with a maximum frequency (e.g., 2500 Hz) to a predefined high value (e.g., 202) associated with a minimum frequency (e.g., 49 Hz). A monitoring microprocessor 280 scans the error signals generated by all the pitch trackers, and selects the one with the smallest error signal and shortest period so as to select the pitch tracker most closely centered on the pitch of the input signal. The coefficients from the selected pitch tracker are read and converted into a phase delay, as described above, to derive an accurate representation of the pitch of the input signal. Once the frequency range of the system 270 is selected, the integer delays of the pitch trackers are not changed. Clearly, the number of pitch trackers needed in the array will depend on the frequency range being scanned. The number of pitch trackers used in the array could be reduced by changing the increment in delay periods between neighboring pitch trackers from $2T_s$ to $3T_s$ or $4T_s$.

In alternate embodiment, the invention could be implemented using an even number N of delayed signal samples and predictor coefficients. The use of an even number of predictor coefficients requires only minor adjustments to the process. For example, when tracking of the signal pitch requires changing the integer period P, equation 21 is applied by reversing the order of the predictor coefficients.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A pitch measurement system which determines the pitch of a quasi-periodic input signal, comprising:

a signal sampler which samples said input signal's value x(t) during a sequence of sample periods;

signal storage, coupled to said signal sampler, which stores a sequence of signal sample values representing said input signal's value during said sequence of sample periods;

means, coupled to said signal storage, for generating an initial estimate $P \cdot T_s$ of said input signal's period $T_0$ where $T_s$ is the length of each said sample period and P is an integer;

means for storing a ordered set of N coefficient values, where N is a positive integer;

a finite impulse response (FIR) filter coupled to said signal storage for generating a predicted signal value $\hat{x}(k)$ for a sampling period k by multiplying each of N of said stored signal sample values, selected in accordance with said initial estimate $P \cdot T_s$ of said input signal's period, by corresponding ones of said N coefficient values and summing the resulting values;

eror means for generating an error signal $\epsilon(k)$ corresponding to the difference between the actual stored signal value x(k) for sampling period k and the predicted signal value $\hat{x}(k)$;

coefficient updating means for periodically updating said coefficient values so as to minimize said error signal $\epsilon(k)$'s mean square value; and measurement output means for generating an output measurement equal to $P \cdot T_s$ plus a phase delay value that is equal to a predefined function of said updated coefficient values.

2. The pitch measurement system of claim 1, wherein said coefficient updating means periodically updates each of said N coefficient values by an amount proportional to the error signal $\epsilon(k)$ multiplied by a corresponding one of the N selected signal values:

$$C_{k+1} = C_k + 2\mu X_k \epsilon(k)$$

where $C_k$ is a vector containing the N coefficient values for sampling period k, $2\mu$ is an adaption parameter that controls the rate at which the coefficient values are adjusted, and $X_k$ is a vector containing the N selected stored signal sample values.

3. The pitch measurement system of claim 1, wherein said measurement output means generates said phase delay value for each sampling period k with respect to a previously computed output measurement.

4. The pitch measurement system of claim 1, further including tracking means for increasing the value of P when said phase delay value is larger than $0.5T_s$, for decreasing the value of P when said phase delay value is less than $-0.5T_s$, and for swapping said coefficient values so as to reverse said ordered set of N coefficient values whenever the value of P is changed.

5. A pitch measurement system which determines the pitch of a quasi-periodic input signal, comprising:

a signal sampler which samples said input signal's value x(t) during a sequence of sample periods;

signal storage, coupled to said signal sampler, which stores a sequence of signal sample values representing said input signal's value during said sequence of sample periods;

means, coupled to said signal storage, for generating an initial estimate $P \cdot T_s$ of said input signal's period $T_0$ where $T_s$ is the length of each said sample period and P is an integer;

means for storing a set of $2M+1$ coefficient values c(i), for $i=-M$ to $+M$, where M is a positive integer;

a finite impulse response (FIR) filter coupled to said signal storage for generating a predicted signal value $\hat{x}(k)$ for sampling period k in accordance with the following formula:

$$\hat{x}(k) = \sum_{i=-M}^{M} x(k - P + i)c(i)$$

where $x(k-P+i)$ is the stored signal sample value for sampling period $k-P+i$;

error means for generating an error signal $\epsilon(k)$ corresponding to the difference between the actual stored signal value x(k) and the predicted signal value $\hat{x}(k)$;

coefficient updating means for periodically updating said coefficient values so as to minimize said error signal $\epsilon(k)$'s mean square value; and measurement output means for generating an output measurement equal to $P \cdot T_s$ plus a phase delay value that is equal to a predefined function of said updated coefficient values.

6. The pitch measurement system of claim 5, wherein said coefficient updating means periodically updates said coefficient values by an amount proportional to the error signal $\epsilon(k)$ multiplied by each of the $2M+1$ selected stored signal sample values:

$$C_{k+1}=C_k+2\mu X_k\epsilon(k)$$

where $C_k$ is a vector containing the $2M+1$ coefficient values for sampling period k, $2\mu$ is an adaption parameter that controls the rate at which the coefficient values are adjusted, and $X_k$ is a vector containing the $2M+1$ selected stored signal sample values for sample periods $k-P-M$ to $k-P+M$.

7. The pitch measurement system of claim 5, wherein said measurement output means generates said phase delay value for each sampling period k with respect to a previously generated output measurement.

8. The pitch measurement system of claim 5, further including tracking means for increasing the value of P when said phase delay value is larger than $0.5T_s$, for decreasing the value of P when said phase delay value is less than $-0.5T_s$, and for swapping each of said coefficient values c(i) with coefficient value c(−i) whenever the value of P is changed.

9. A pitch measurement system which determines the pitch of a quasi-periodic input signal, comprising:

a signal sampler which samples said input signal's value x(t) during a sequence of sample periods;

signal storage, coupled to said signal sampler, which stores a sequence of signal sample values representing said input signal's value during said sequence of sample periods;

a multiplicity of parallel signal pitch trackers, each said signal pitch tracker having assigned thereto an initial estimate $P\cdot T_s$ of said input signal's period $T_0$ where $T_s$ is the length of each said sample period and P is an integer; wherein a different value of P is assigned to each of said multiplicity of parallel signal pitch trackers; each said signal pitch tracker generating an estimated signal period value and an error signal value;

monitoring means, coupled to said multiplicity of parallel signal pitch trackers, for monitoring said error signal values generated by said multiplicity of parallel signal pitch trackers and for outputting the estimated signal period value generated by the one of said signal pitch trackers with the lowest error signal value;

each of said multiplicity of parallel signal pitch trackers including:

means for storing a ordered set of N coefficient values, where N is a positive integer;

a finite impulse response (FIR) filter coupled to said signal storage for generating a predicted signal value $\hat{x}(k)$ for a sampling period k by multiplying each of N of said stored signal sample values, selected in accordance with said initial estimate $P\cdot T_s$ of said input signal's period, by corresponding ones of said N coefficient values and summing the resulting values;

error means for generating an error signal $\epsilon(k)$ corresponding to the difference between the actual stored signal value x(k) for sampling period k and the predicted signal value $\hat{x}(k)$;

coefficient updating means for periodically updating said coefficient values so as to minimize said error signal $\epsilon(k)$'s mean square value; and output means for generating an output measurement equal to $P\cdot T_s$ plus a phase delay value that is equal to a predefined function of said updated coefficient values.

10. A pitch measurement method which determines the pitch of a quasi-periodic input signal, the steps of the method comprising:

sampling said input signal's value x(t) during a sequence of sample periods;

storing a sequence of signal sample values representing said input signal's value during said sequence of sample periods;

using said stored sequence of signal sample values, generating an initial estimate $P\cdot T_s$ of said input signal's period $T_0$ where $T_s$ is the length of each said sample period and P is an integer;

storing an ordered set of N coefficient values, where N is a positive integer;

selecting, in accordance with said initial estimate $P\cdot T_s$ of said input signal's period, N of said stored signal sample values; (B) generating a predicted signal value $\hat{x}(k)$ for a sampling period k by multiplying each of said N selected signal sample values by corresponding ones of said N coefficient values and summing the resulting values; and (C) generating an error signal $\epsilon(k)$ corresponding to the difference between the actual stored signal value x(k) for sampling period k and the predicted signal value x(k);

updating said coefficient values so as to minimize said error signal $\epsilon(k)$'s means square value; and generating an output measurement equal to $P\cdot T_s$ plus a phase delay value that is equal to a predefined function of said updated coefficient values.

11. The pitch measurement method of claim 10, wherein said coefficient value updating step periodically updates each of said coefficient values by an amount proportional to the error $\epsilon$ multiplied by a corresponding one of the N selected signal values:

$$C_{k+1}=C_k+2\mu X_k\epsilon(k)$$

where $C_k$ is a vector containing the N coefficient values for sampling period k, $2\mu$ is an adaption parameter that controls the rate at which the coefficient values are adjusted, and $X_k$ is a vector containing the N selected stored signal sample values.

12. The pitch measurement method of claim 10, wherein said output measurement generating step computes for each sampling period k said phase delay value with respect to a previously computed output measurement.

13. The pitch measurement method of claim 10, further including the steps of:

increasing the value of P when said phase delay value is larger than $0.5T_s$; decreasing the value of P when said phase delay value is less than $-0.5T_s$; and for swapping said coefficient values so as to reverse said ordered set of N coefficient values whenever the value of P is changed.

14. A pitch measurement method which determines the pitch of a quasi-periodic input signal, the steps of the method comprising:

sampling said input signal's value x(t) during a sequence of sample periods;

storing a sequence of signal sample values representing said input signal's value during said sequence of sample periods;

using said stored sequence of signal sample values, generating an initial estimate $P \cdot T_s$ of said input signal's period $T_0$ where $T_s$ is the length of each said sample period and P is an integer;

storing a set of 2M+1 coefficient values c(i), for i=−M to +M, where M is a positive integer;

selecting 2M+1 of said stored signal sample values corresponding to sample periods delayed from a current signal sample period k by periods ranging from $(P-M)T_s$ to $(P+M)T_s$, generating a predicted signal value $\hat{x}(k)$ for sampling period k in accordance with the following formula:

$$\hat{x}(k) = \sum_{i=-M}^{M} x(k - P + i)c(i)$$

where x(k−P+i) is the stored signal sample value for sampling period k−P+i, and generating an error signal $\epsilon(k)$ corresponding to the difference between the actual stored signal value x(k) and the predicted signal value x(k);

updating said coefficient values so as to minimize said error signal $\epsilon(k)$'s means square value; and generating an output measurement equal to $P \cdot T_s$ plus a phase delay value that is equal to a predefined function of said updated coefficient values.

15. The pitch measurement method of claim 14, wherein said coefficient value updating step periodically updates said coefficient values by an amount proportional to the error $\epsilon$ multiplied by each of the 2M+1 time lagged signal values:

$$C_{k+1} = C_k + 2\mu X_k \epsilon(k)$$

where $c_k$ is a vector containing the 2M+1 coefficient values for time period k, $2\mu$ is an adaption parameter that controls the rate at which the prediction coefficients are adjusted, and $X_k$ is a vector containing the 2M+1 selected stored signal sample values for sample periods k−P−M to k−P+M.

16. The pitch measurement method of claim 14, wherein said output measurement generating step computes for each sampling period k said phase delay value with respect to a previously computed estimate signal period value for said input signal.

17. The pitch measurement method of claim 14, further including the steps of:

increasing the value of P when said phase delay value is larger than $0.5T_s$; decreasing the value of P when said phase delay value is less than $-0.5T_s$; and swapping each of said coefficient values c(i) with coefficient value c(−i) whenever the value of P is changed.

* * * * *